US005239965A

United States Patent [19]

Ninomiya

[11] Patent Number: 5,239,965

[45] Date of Patent: Aug. 31, 1993

[54] FUEL INJECTION CONTROL APPARATUS FOR INTERNAL COMBUSTION ENGINE

[75] Inventor: Masahito Ninomiya, Toyota, Japan

[73] Assignee: Toyota Jidosha Kabushiki Kaisha, Toyota, Japan

[21] Appl. No.: 887,353

[22] Filed: May 21, 1992

[30] Foreign Application Priority Data

May 30, 1991 [JP] Japan ..... 3-127283

[51] Int. Cl.[5] ..... F02M 51/00

[52] U.S. Cl. ..... 123/492; 123/676

[58] Field of Search ..... 123/492, 676, 494; 60/277, 274, 285

[56] References Cited

U.S. PATENT DOCUMENTS

| | | | |
|---|---|---|---|
| 4,123,901 | 11/1978 | Masaki et al. | 60/277 |
| 4,305,364 | 12/1981 | Stuckas | 123/676 |
| 4,319,451 | 3/1982 | Tajima et al. | 60/274 |
| 4,400,944 | 8/1983 | Iwamoto et al. | 123/676 |
| 4,870,942 | 10/1989 | Shibata et al. | 123/676 |
| 4,960,451 | 10/1990 | Tachibana et al. | 123/494 |
| 4,964,051 | 10/1990 | Sekozawa et al. | 364/431.04 |
| 5,103,791 | 4/1992 | Tomisawa | 123/676 |

FOREIGN PATENT DOCUMENTS

| | | |
|---|---|---|
| 3904750A1 | 2/1989 | Fed. Rep. of Germany . |
| 3919778A1 | 12/1989 | Fed. Rep. of Germany . |
| 51240 | 3/1983 | Japan . |
| 43144 | 3/1985 | Japan . |
| 90939 | 5/1985 | Japan . |
| 18150 | 1/1988 | Japan . |
| 45445 | 2/1988 | Japan . |
| 4737 | 2/1991 | Japan . |
| 225043 | 10/1991 | Japan . |

*Primary Examiner*—Raymond A. Nelli
*Attorney, Agent, or Firm*—Kenyon & Kenyon

[57] ABSTRACT

A fuel injection control apparatus includes a detection part for detecting whether or not an internal combustion engine is operating in prescribed high load conditions, a fuel injection control part for increasing a fuel injection time during which an amount of fuel proportional to the fuel injection time is supplied to the engine, a delaying part for delaying increase of the fuel injection time until a prescribed delay time has elapsed since the high load conditions are detected, a heat condition measuring part for measuring a heat condition of exhaust parts of the engine prior to the detection of the high load conditions, and a delay time control part for varying the delay time of the delaying part in response to a measured heat condition of the exhaust parts, thereby preventing overheating of the exhaust parts during the high load conditions of the engine.

12 Claims, 9 Drawing Sheets

FIG. 10

FOTP MAP

| NErpm / PM | 1000 | 2000 | 3000 | 4000 | 5000 | 6000 | 7000 | 8000 | 9000 |
|---|---|---|---|---|---|---|---|---|---|
| 150 | 0 | 0 | 0 | 0 | 0 | 0 | 0 | 0 | 0 |
| 300 | 0 | 0 | 0 | 0 | 0 | 0 | 0 | 0.15 | 0.15 |
| 450 | 0 | 0 | 0 | 0 | 0 | 0 | 0.15 | 0.15 | 0.15 |
| 600 | 0 | 0 | 0 | 0 | 0 | 0.15 | 0.15 | 0.15 | 0.15 |
| 750 | 0 | 0 | 0 | 0 | 0 | 0.15 | 0.15 | 0.15 | 0.20 |
| 900 | 0 | 0 | 0 | 0.15 | 0.15 | 0.15 | 0.15 | 0.20 | 0.25 |
| 1050 | 0.15 | 0.15 | 0.15 | 0.15 | 0.15 | 0.15 | 0.20 | 0.25 | 0.30 |
| 1200 | 0.15 | 0.15 | 0.15 | 0.15 | 0.15 | 0.30 | 0.30 | 0.40 | 0.50 |
| 1350 | 0.15 | 0.15 | 0.15 | 0.20 | 0.30 | 0.35 | 0.40 | 0.50 | 0.60 |

FUEL INJECTION CONTROL APPARATUS FOR INTERNAL COMBUSTION ENGINE

BACKGROUND OF THE INVENTION (1) Field of the Invention

The present invention generally relates to a fuel injection control apparatus, and more particularly to an apparatus for controlling a fuel injection time for a fuel injector in response to operating conditions of an internal combustion engine.

(2) Description of the Related Art

If an internal combustion engine continuously operates in a high load region, exhaust parts (e.g., a catalytic converter) are heated by exhaust gas from the engine and the temperatures of the exhaust parts increase to a high level. When the exhasut gas temperature exceeds a certain high temperature and the engine is still operating within the high load region, the exhaust parts may be damaged due to the heat of exhaust gas. Generally, in order to avoid damaging the parts, a fuel injection time, during which fuel is injected to the engine by a fuel injector, is increased so that the fuel injection sends a more rich air-fuel mixture to the engine when it is detected that the operating conditions of the engine lie in a prescribed high load region. The increase of the fuel injection time is called hereinafter the over-temperature protect (OTP) process, and when a fuel injection control apparatus performs this OTP process the fuel injection amount is increased. If the fuel injection amount is increased so as to send a rich air-fuel mixture to the engine immediately when the engine is detected as operating in the high load region, it is possible to prevent an undesired increase of the exhaust gas temperature to a cetain extent, due to cooling after the heat of fuel vaporization is consumed, and due to a decrease of combustion efficiency accompanied by a decrease in amount of oxygen gas in the air-fuel mixture. However, because the exhaust parts have a certain heat capacity, the exhaust parts are not immediately damaged by the heat of exhaust gas when the engine is operating in a prescribed high load region. The above mentioned OTP process is usually performed after a given delay time has elapsed during which the engine operates in the prescribed region, so that the fuel injection amount is increased after the exhaust part temperatures have increased to almost the same level as the exhaust gas temperature.

Generally speaking, a difference between the exhaust part temperature and the part damage temperature becomes smaller when a higher exhaust part temperature is detected when the engine is operating in a prescribed high load region. Thus, if the detected exhaust gas temperature is high, the time for the exhaust part temperature to reach the part damage level at which the exhaust parts are damaged due to the exhaust gas heat becomes short.

In the prior art, there is an apparatus for controlling a fuel injection time in response to operating conditions of an engine so that the overheating of exhaust parts, after an engine load (detected from the engine operating conditions) higher than a prescribed level is detected, is prevented. For example, Japanese Laid-Open Patent Publication No.60-43144 discloses such an apparatus. In this conventional apparatus, an exhaust gas sensor is mounted in an exhaust pipe of an engine. When it is detected that the engine load is higher than a prescribed level, an exhaust gas temperature is sensed by the exhaust gas sensor. In this system, the delay time between detection of the high engine load and increasing of the fuel injection time is varied in response to the sensed exhaust gas temperature. More specifically, the delay time is decreased when the exhaust gas temperature is high, and when the exhaust gas temperature is low the delay time is increased.

However, the exhaust gas temperature measured by the sensor when the engine load is higher than a prescribed level does not represent correct temperatures of exhaust parts at that time. Becuase the exhaust parts have a certain heat capacity, the temperatures of the exhaust parts increase to the measured exhuast gas temperature slightly after the exhaust gas temperature just measured by the sensor. In other words, there is a delay between detection of the exhaust gas temperature and increase of the exhaust part temperatures. If the exhaust gas temperature measured when the engine load is higher than a prescribed level is at the same level, the exhaust part temperatures at that time are different depending on the heat energy having been given to the exhaust parts prior to the detection of the high engine load condition. An exhaust part temperature is obviously higher when a great amount of heat energy has been given than when a small amount of heat energy has been given. Thus, if the above described delay time is changed to a smaller value when the exhaust gas temperature is found to be high, as in the above mentioned conventional apparatus, there is a problem in that the increase of the fuel injection time is performed immediately although the exhaust part temperature has not yet increased to the measured exhaust gas temperature, and it is not yet necessary at that time to change the fuel injection time. Therefore, due to an undesired increase of the fuel injection amount, the fuel efficiency is decreased.

SUMMARY OF THE INVENTION

Accordingly, it is a general object of the present invention to provide an improved fuel injection control apparatus in which the above described problems are eliminated.

Another and more specific object of the present invention is to provide a fuel injection control apparatus in which the delay time between detection of the high engine load and increase of the fuel injection time is suitably controlled in response to a detected heat condition of the exhaust parts prior to the detection of the high load condition, thus preventing overheating of the exhaust parts when the engine is in high load conditions, and increasing the fuel efficiency. The above mentioned object of the present invention can be achieved by a fuel injection control apparatus which includes a detection part for detecting whether or not an internal combustion engine is operating in prescribed high load conditions, a fuel injection control part for increasing or decreasing a fuel injection time during which an amount of fuel proportional to the fuel injection time is supplied to the engine, a delaying part for delaying increase of the fuel injection time by the fuel injection control part unitl a delay time has elapsed since the high load conditions are detected by the detection part, a heat condition measuring part for measuring a heat condition of exhaust parts of the engine prior to the detection of the high load conditions, and a delay time control part for varying the delay time of the delaying part in response to a measured heat condition of the exhaust parts measured by the heat condition measuring part. According to the present invention, it is possible to prevent the fuel injection time from increasing unnecessarily when high load conditions of the engine are detected. Because the delay time is suitably adjusted in response to the heat condition of the exhaust parts, overheating of the exhaust parts can be prevented, thus increasing the fuel efficiency.

Other objects and further features of the present invention will become apparent from the following detailed description when read in conjunction with the accompanying drawings.

BRIEF DESCRIPTION OF THE DRAWINGS

FIG.10 is a table for explaining FOTP map data describing over-temperature-protect (OTP) control values preset in accordance with a relationship between intake vacuum pressure and engine speed.

DESCRIPTION OF THE PREFERRED EMBODIMENTS

Figure 1:
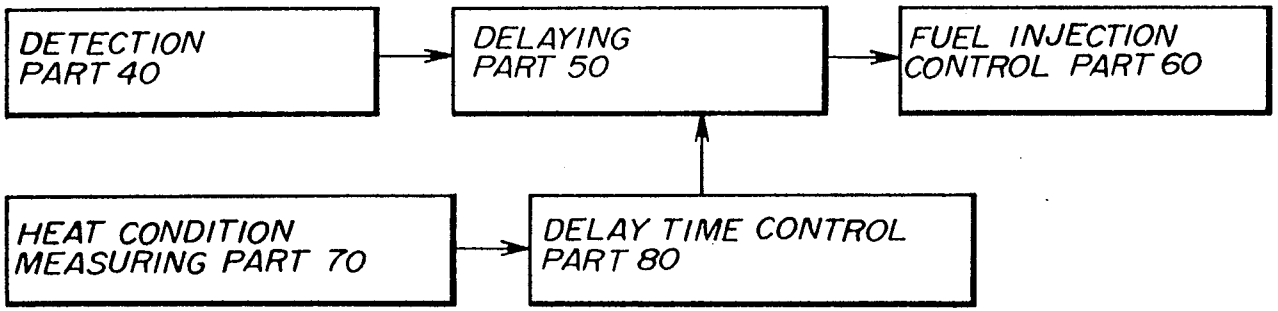
FIG.1 is a block diagram showing an embodiment of a fuel injection control apparatus according to the present invention.

A description will now be given, with reference to FIG.1, of a fuel injection control apparatus according to the present invention. In FIG.1, the fuel injection control apparatus includes a detection part 40 for detecting whether or not an internal combustion engine is operating in prescribed high load conditions, a fuel injection control part 60 for increasing a fuel injection time during which an amount of fuel proportional to the fuel injection time is injected into the engine, a delaying part 50 for delaying increase of the fuel injection time by the fuel injection control part 60 unitl a prescribed delay time has elapsed since the high load conditions are detected by the detection part 40, a heat condition measuring part 70 for measuring a heat condition of exhaust parts of the engine prior to the detection of the high load conditions, and a delay time control part 80 for varying the delay time of the delaying part 50 in response to a measured heat condition of the exhaust parts as measured by the heat condition measuring part 70. In the fuel injection control apparatus of the present invention, a heat condition of the exhaust parts prior to the detection of the high load conditions is measured, and, in response to the measured heat condition of the exhaust parts, the delay time is suitably varied in such a manner that deterioration of the fuel efficiency, due to variation of thermal conditions to which the exhaust parts have been subjected prior to the detection of the high load conditions of the engine, is prevented.

Figure 2:
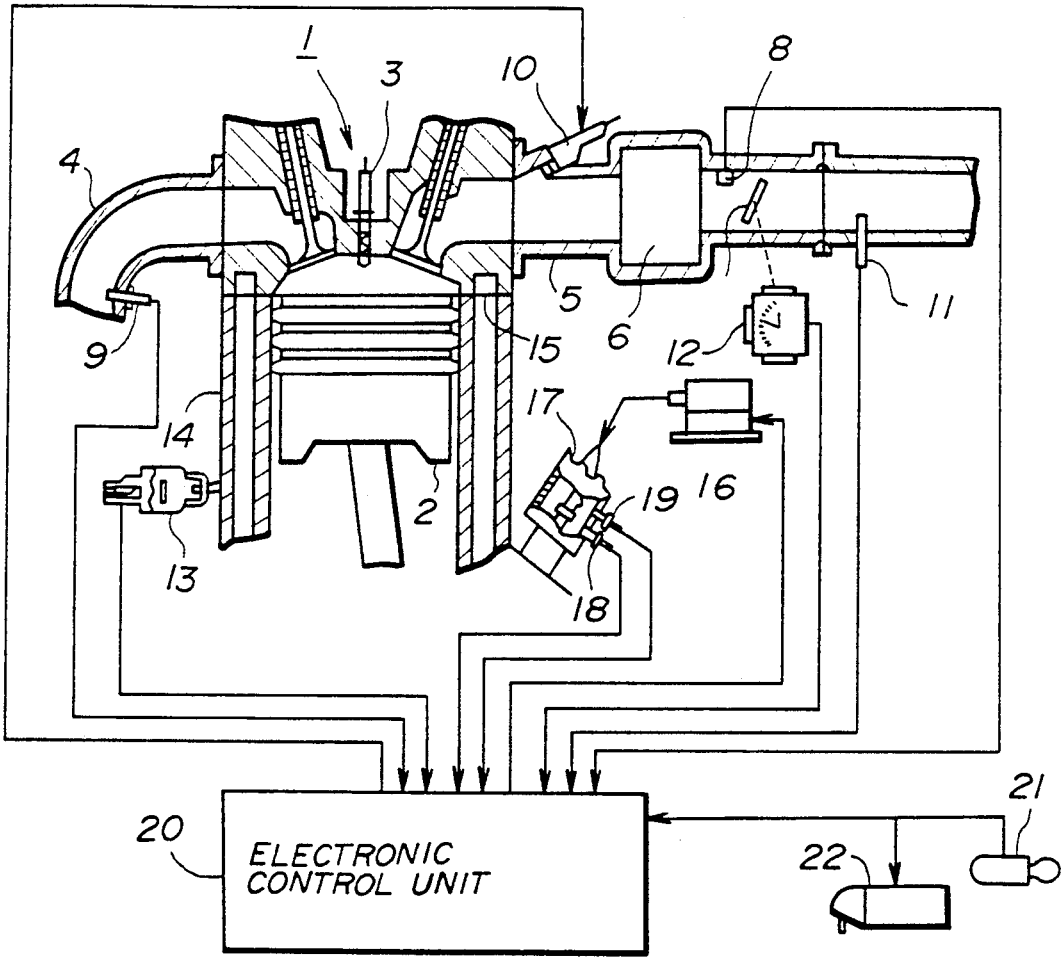
FIG.2 is a view showing an internal combustion engine to which the present invention is applied.

Next, a description will be given, with reference to FIG.2, of an internal combustion engine to which the present invention is applied. In FIG.2, a gasoline engine 1 is shown schematically. The engine shown includes a piston 2, a spark plug 3, an exhaust pipe 4, an intake pipe 5, a surge tank 6 for absorbing irregular movement of intake air in the intake pipe 5 of the engine, a throttle valve 7 for controlling a flow of the intake air, and a vacuum sensor 8 to detect a vacuum pressure in the intake pipe 5. In the exhaust pipe 4, an oxygen sensor 9 is provided so as to detect a concentration of oxygen gas in exhaust gas passing through the exhaust pipe 4. At an intermediate portion of the intake pipe 5, downstream of the surge tank 6, a fuel injector 10 is provided for injecting fuel to the intake air flowing into the engine 1. An air temperature sensor 11 is mounted upstream of the throttle valve 7, so as to detect a temperature of the air flowing into the intake pipe 5. A throttle position sensor 12 is mounted so as to detect a valve opening position of the throttle valve 7. In a cylinder block 14 of the engine 1, a knock sensor 13 is mounted in order to detect whether or not a knocking occurs in a combustion chamber of the engine 1. A water temperature sensor 15 is mounted in a water jacket of the engine to detect a temperature of engine cooling water.

An igniter 16 generates a high voltage required for the spark plug 3 to ignite. A distributor 17 applies electric current, due to the high voltage generated by the igniter 16, to the spark plug of each cylinder of the engine, properly, in accordance with the rotation of a crankshaft (not shown). A revolution sensor 18 is mounted on the distributor 17 for outputting twenty-four pulses of rotation angle signals per revolution of the distributor 17 (corresponding to two revolutions of the crankshaft). The rotation angle signals output by the revolution sensor 18 describe a value of engine speed NE. A cylinder check sensor 19 is mounted on the distributor 17 for outputting one pulse of a rotation detection signal G per revolution of the distributor 17. The rotation detection signal G is used to detect a revolution of the crankshaft. An electric control unit (ECU) 20 receives such a detection signal input by each of the above mentioned sensors, and outputs control signals to the fuel injector 10 and to the other parts respectively in response to the input. A key switch 21 and a starter motor 22 are coupled to the ECU 20.

Figure 3:
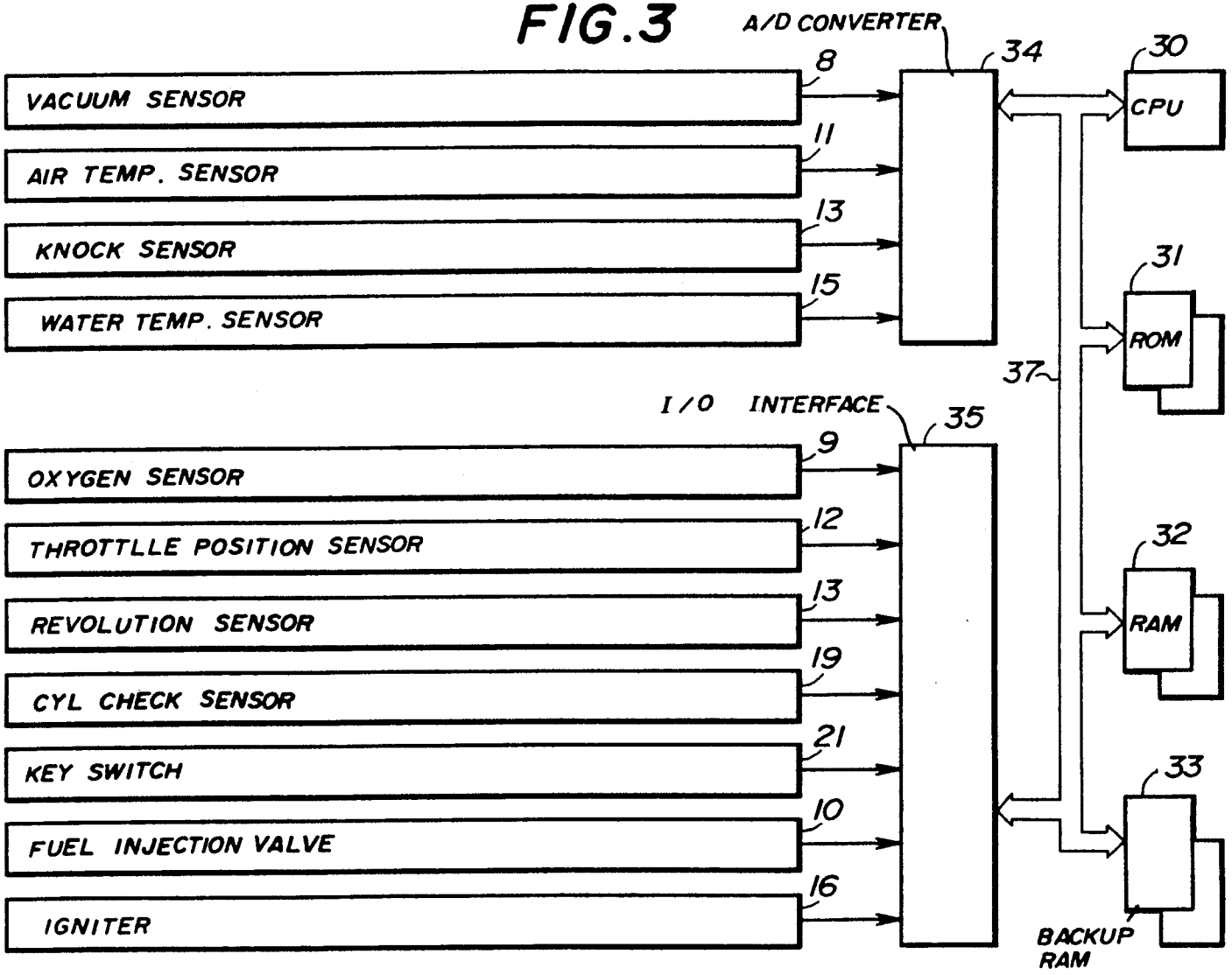
FIG.3 is a diagram showing an electronic control unit provided in the internal combustion engine of FIG.2.

FIG.3 shows the construction of the ECU 20. In FIG.3, the ECU 20 includes a central processing unit (CPU) 30, a read only memory (ROM) 31 for storing a control program and map data (which will be described later), a random access memory (RAM) 32 providing a working area used by the CPU 30 when the control program is executed, a Backup RAM 33 for retaining necessary data if electric power is turned off, an analog-to-digital (A/D) converter 34 having a multiplexer function, and an input/output (I/O) interface 35 having a buffer function. These component parts of the ECU 20 are interconnected by a bi-directional bus 37.

A signal supplied by the vacuum sensor 8, which indicates an intake vacuum pressure PM in the intake pipe, a signal supplied by the air temperature sensor 11, which indicates an intake air temperature, a signal supplied by the knock sensor 13, which indicates occurrence of knocking in the engine, and a signal supplied by the water temperature sensor 15, which indicates a temperature of engine cooling water are input to the A/D converter 34. The A/D converter 34 converts these signals into digital signals, and each of the digital signals from the A/D converter 34 is read out by the CPU 30 via the bus 37. Similarly, signals supplied by the oxygen sensor 9, the throttle position sensor 12, the revolution sensor 18, the cylinder check sensor 19, and the key switch 21 are input to the I/O interface 35, and each of the signals output by the I/O interface 35 is read out by the CPU 30. The CPU 30 determines an ignition time and a fuel injection time based on the signals supplied by the above mentioned sensors. The CPU 30 outputs a signal indicating the ignition time to the igniter 16 via the I/O interface 35, and outputs a signal indicating the fuel injection time to the fuel injector 10 via the I/O interface 35.

Figure 4:
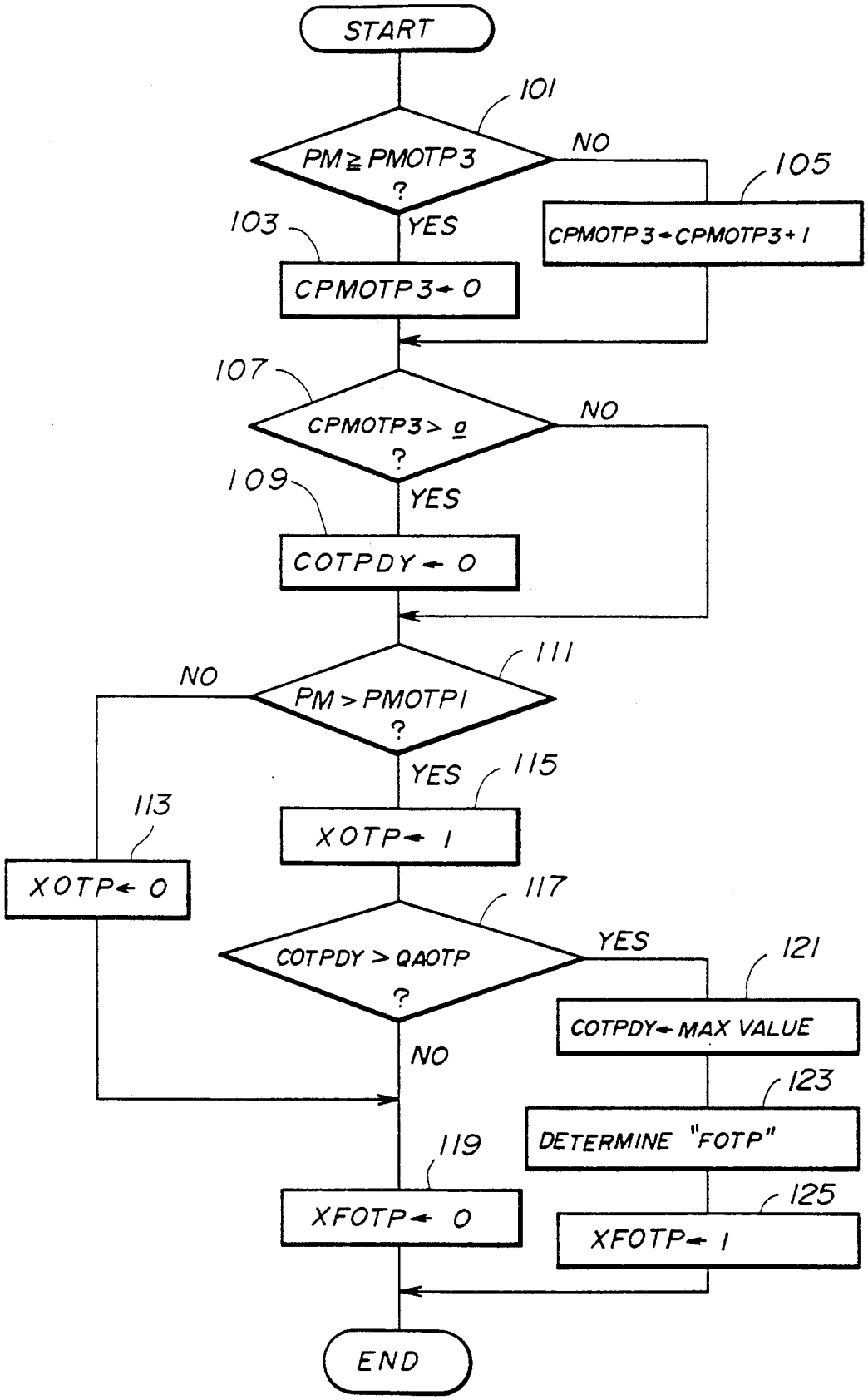
FIG.4 is a flow chart for explaining a delay time process in which a heat condition of exhaust parts prior to detection of high load conditions is measured.
Figure 8:
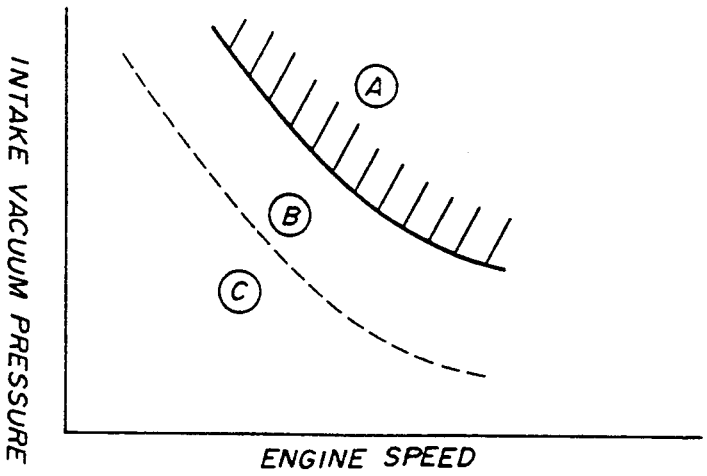
FIG.8 is a diagram for explaining heat conditions of exhaust parts corresponding to engine operating conditions described in a relationship between intake vacuum pressure and engine speed.

Next, a description will be given of several processes performed when the control program stored in the ROM 31 is executed by the CPU 30. FIG.4 shows a delay time process in which a delay time between detection of the high load condition of the engine and increase of the fuel injection time is determined. The delay time process shown in FIG.4 is a main routine executed by the CPU 30, and this routine is executed repeatedly at given time intervals. FIG.8 shows several heat conditions of the exhaust parts which are varied depending on engine operating conditions. The engine operating conditions are described by engine speed NE and intake vacuum pressure PM.

In the delay time process of FIG.4, step 101 detects whether or not an intake vacuum pressure PM measured by the vacuum sensor 8 is higher than a prescribed reference value PMOTP3. This reference value PMOTP3 is used to determine whether or not the exhaust parts are in a prescribed low-load heat condition. The reference values PMOTP3 are preset in accordance with the engine speed values, and one of the reference values PMOTP3 is read out, from map data stored in the ROM 31, in response to a detected engine speed NE supplied by the revolution sensor 18. A relationship between the reference values PMOTP3 and the engine speed NE is as shown in TABLE 1 below.

TABLE 1

| | | | | | |
|---|---|---|---|---|---|
| NE (rpm) | 1200 | 1600 | 2000 | 2400 | 2800 |
| PMOTP1 | 800 | 800 | 730 | 670 | 650 |
| PMOTP2 | 800 | 730 | 700 | 650 | 610 |
| PMOTP3 | 610 | 600 | 500 | 420 | 369 |
| NE (rpm) | 3200 | 3600 | 4400 | 5200 | 6000 |
| PMOTP1 | 600 | 500 | 250 | 150 | 150 |
| PMOTP2 | 570 | 440 | 250 | 150 | 150 |
| PMOTP3 | 213 | 10 | 10 | 10 | 10 |

When it is detected in step 101 that the PM is lower than the PMOTP3, the operating conditions of the engine lie in a region "C" of FIG.8, and it is assumed that the temperatures of the exhaust parts are decreasing when the engine is in such conditions. Step 105 performs a counting of CPMOTP3 with respect to the low-load heat condition of the exhaust parts. In step 105, the value of CPMOTP3 is incremented (CPMOTP3 ←CPMOTP3+1) each time the engine operating conditions lie in the region "C". The value of CPMOTP3 thus indicates a time duration during which the exhaust part temperatures are decreasing. On the other hand, when the PM is higher than or equal to the PMOTP3, the operating conditions of the engine lie in a region "A" or in a region "B" of FIG.8. Step 103 resets the CPMOTP3 to zero when it is detected that the PM is not lower than the PMOTP3.

Then, in step 107, the value of CPMOTP3 is compared with a prescribed count number "a". When the value of CPMOTP3 is smaller than the count number "a", step 111 is performed. When the value of CPMOTP3 is greater than the count value "a", step 109 sets the delay count COTPDY to zero, and step 111 is then performed. A zero value of the COTPDY indicates that the engine is continuously operating in such conditions and the exhaust parts are cooled to a sufficiently low temperature.

Step 111 detects whether or not the detected intake vacuum pressure PM is higher than a prescribed high-load reference value PMOTP1. This value PMOTP1 is used to determine whether or not the exhaust parts are in a prescribed high-load heat condition. The reference values PMOTP1 are preset in accordance with the engine speed values, as shown in TABLE 1 above. One of the reference values PMOTP1 is read out, from the map data stored in the ROM 31, in response to a detected engine speed NE supplied by the revolution sensor 18. The region "A", indicated by a shaded area in FIG.8, wherein the detected PM is higher than the high-load reference value PMOTP1, represents an OTP region in which the OTP process is performed so as to increase the fuel ignition time. If it is detected in step 111 that the engine operating conditions lie in this OTP region, the OTP process is performed to increase the fuel injection time.

In TABLE 1 above, another kind of reference values PMOTP2 are given in accordance with the engine speed values, in addition to the above mentioned PMOTP1 and PMOTP3. The values of PMOTP1 are used to detect whether or not the engine operating conditions lie in a predetermined first OTP region when a basic ignition time is used with no ignition delay. The values of PMOTP2 are used to detect whether or not the engine operating conditions lie in a predetermined second OTP region when the basic ignition time is delayed by means of a suitable knock control system. In FIG.8, the first OTP region (region "A") corresponding to the case of the basic ignition time being used with no delay is slightly narrower than the second OTP region (region "A" plus part of region "B") corresponding to the case of the delayed ignition time being used. In this embodiment, the first OTP region (region "A") is used with the high-load reference values of the PMOTP1.

If it is detected in step 111 that the PM is not higher than the PMOTP1 (the engine operating conditions lie in the region "B" or in the region "C" of FIG.8), step 113 sets an OTP region flag XOTP to zero and step 119 sets an OTP process enable flag XFOTP to zero. In other words, when the engine operating conditions lie in the region "B" or in the region "C", the OTP process is not performed. On the other hand, if it is detected that the PM is higher than the PMOTP1 (the engine operating conditions lie in the region "A" of FIG.8), step 115 sets the flag XOTP to 1. The value of the flag XOTP equal to 1 indicates that the exhaust part temperatures are increasing due to the exhaust gas heat, and that the exhaust parts may overheat unless the OTP process is performed.

Figure 5:
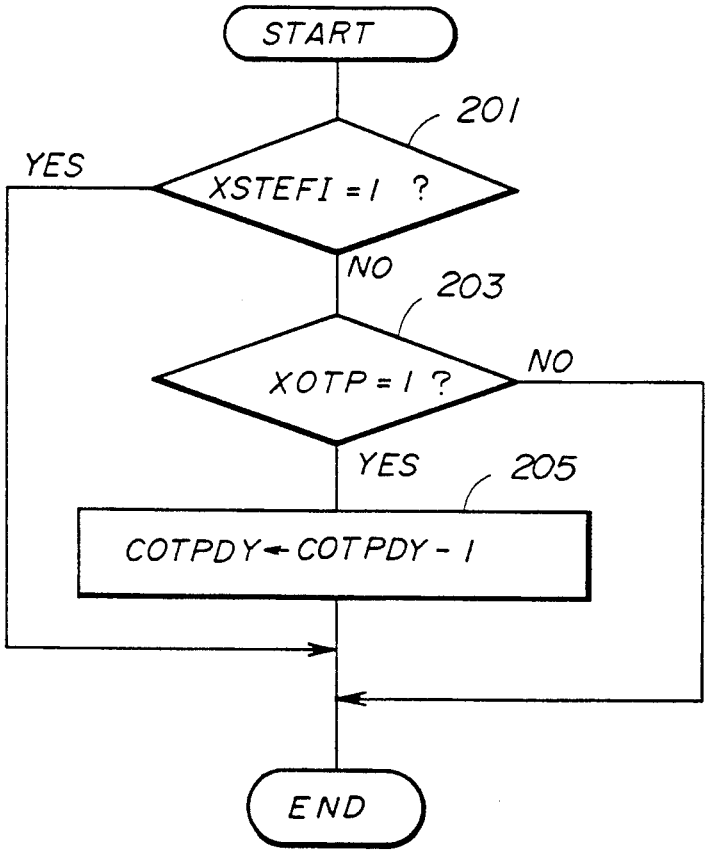
FIG.5 is a flow chart for explaining a delay counting process in which a delay count is determined.

After the flag XOTP is set to 1, step 117 detects whether or not the delay count value COTPDY, obtained through the subroutine of FIG.5, is greater than a prescribed reference delay value QAOTP read out from map data stored in the ROM 31. The value of the count COTPDY represents the extent to which the exhaust part temperatures have been raised, due to the exhaust gas heat, prior to the detection of the high-load heat condition of the engine. If it is detected that the COTPDY is greater than the QAOTP, it is judged that the exhaust parts will shortly overheat, and step 121 is therefore performed. If it is detected that the COTPDY is not greater than the QAOTP, it is judged that the exhaust parts will not shortly overheat, and therefore step 119 sets the OTP process enable flag XFOTP to zero, so that the OTP process is not performed.

The following TABLE 2 shows the reference delay values QAOTP, one of which is read out in step 117. These reference delay values are stored in the ROM 31 and are preset in accordance with flow rate values QA of the air entering the intake pipe 5. The exhaust gas temperatures vary depending on the flow rate of the intake air (which depends on the engige load). It should be noted that, generally speaking, the rate of increase of exhaust part temperatures varies in accordance with the intake air flow rate.

TABLE 2

| | | | | |
|---|---|---|---|---|
| QA (l/sec) | 21 | 29 | 37 | 45 |
| QAOTP (sec) | 26 | 19 | 16 | 6 |

In step 121, the maximum value is set to the delay count COTPDY. It is judged at this time that the exhaust part temperatures are already high and the exhaust parts will shortly overheat due to the exhaust gas heat. Once the maximum value is set to the count COTPDY it will be detected in step 117 in a subsequent cycle of the same process that the COTPDY is greater than the QAOTP, and therefore steps 121 to 125 will be performed in the subsequent cycle unless the COTPDY is set to zero in step 109. In step 123, an OTP control value FOTP is read out from map data stored in the ROM 31 in response to the detected engine speed value NE and in response to the detected intake vacuum pressure value PM. FIG.10 shows FOTP map data stored in the ROM 31. The FOTP map data defines OTP control values preset in accordance with a relationship between the intake vacuum pressure PM and engine speed NE. An OTP control value FOTP obtained in step 123 is used to calculate a fuel injection time TAU in the fuel injection control process of FIG.6. Step 125 sets the OTP process enable flag XFOTP to 1, and the OTP process is immediately performed so as to increase the fuel injection time.

FIG.5 shows a delay counting process in which the delay count value COTPDY is incremented each time it is detected that the operating conditions of the engine lie in the OTP region. This delay counting process is performed as a subroutine of the main routine of FIG.4, and it is executed repeatedly at given time intervals. The resulting delay count value COTPDY is compared with the stored reference delay value QAOTP in step 117 of FIG.4.

In the delay time counting process of FIG.5, step 201 checks whether or not a start mode flag XSTEFI is equal to 1. In this embodiment, it is assumed that the engine stops operating, or it is cranking, if an engine speed below 400 rpm is detected. When a detected engine speed is below 400 rpm, the start mode flag XSTEFI is set to 1 and the process of FIG.5 ends. When the detected engine speed is higher than 400 rpm, the start mode flag XSTEFI is set to zero, and step 203 is performed. Step 203 checks whether or not the OTP region flag XOTP is equal to 1. As described above with the main routine of FIG.4, when the detected PM is higher than the stored reference value PMOTP1, the flag XOTP is set to the value one (it indicates that the engine operating conditions lie in the OTP region), and when the PM is not higher than the PMOTP1 the flag XOTP is set to the value zero (it indicates that the engine operating conditions do not lie in the OTP region). Thus, if it is detected in step 203 that the XOTP is not equal to 1, then the process of FIG.5 ends. If it is detected that the XOTP is equal to 1, step 205 performs a counting of the delay count COTPDY. That is, in step 205, the delay count value COTPDY is incremented (COTPDY ←COTPDY+1). Hence, when the engine operating conditions lie in the OTP region, the delay count value COTPDY is incremented. In this case, the exhaust parts are heated due to the exhaust gas heat, and the exhaust part temperatures are increased. A level of the exhaust part temperature is represented by a time duration during which the engine operating conditions remain in the OTP region. This time duration corresponds to the delay count value COTPDY obtained in the above process.

Figure 6:
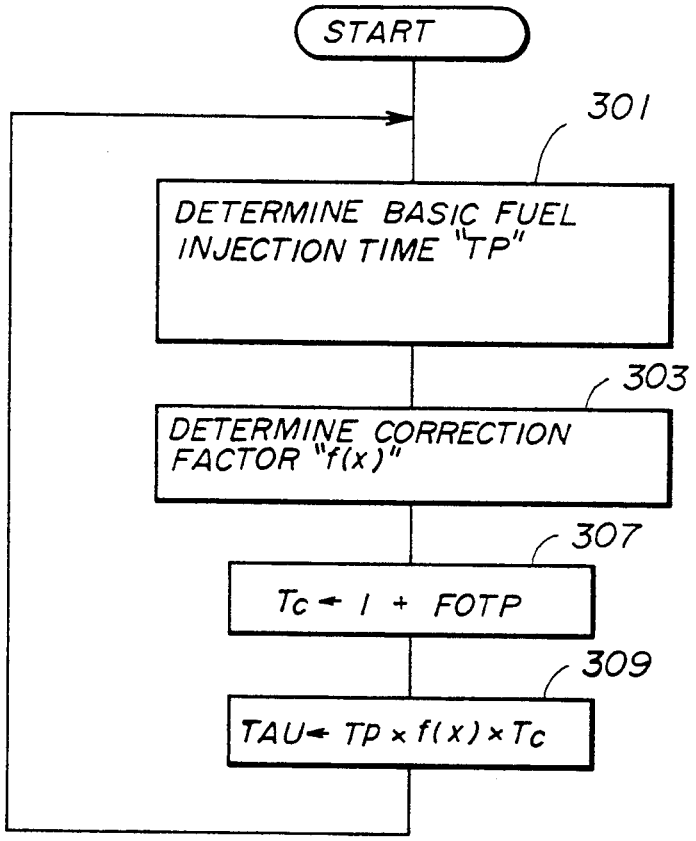
FIG.6 is a flow chart for explaining a fuel injection control process in which a fuel injection time for a fuel injector is calculated.

FIG.6 shows a fuel injection control process in which a fuel injection time is determined for controlling the amount of fuel injected by the fuel injector 10. In this fuel injection control process, step 301 determines a basic fuel injection time TP based on an engine speed and an intake vacuum pressure both determined by the operating conditions of the engine. Step 303 determines a fuel injection correction factor f(x) based on an intake air temperature detected by the air temperature sensor 11, based on a cooling water temperature detected by the water temperature sensor 15, and based on an oxygen concentration detected by the oxygen sensor 9. When the engine load is higher than a prescribed level, an air-fuel ratio feedback control process is not performed. However, when the air fuel ratio of the mixture supplied to the engine is lower than a stoichiometric ratio, the air-fuel ratio feedback control process is performed in response to a signal output by the oxygen sensor 9.

Step 307 calculates a fuel injection correction rate Tc by adding the value one to the FOTP. This FOTP is a value obtained in step 123 of FIG.4 by reading out from the stored FOTP map data in the ROM 31. Thus, step 309 calculates a fuel injection time TAU in accordance with the following formula.

$$TAU = TP * f(x) * Tc \quad (1)$$

Figures 9A, 9B, 9C:
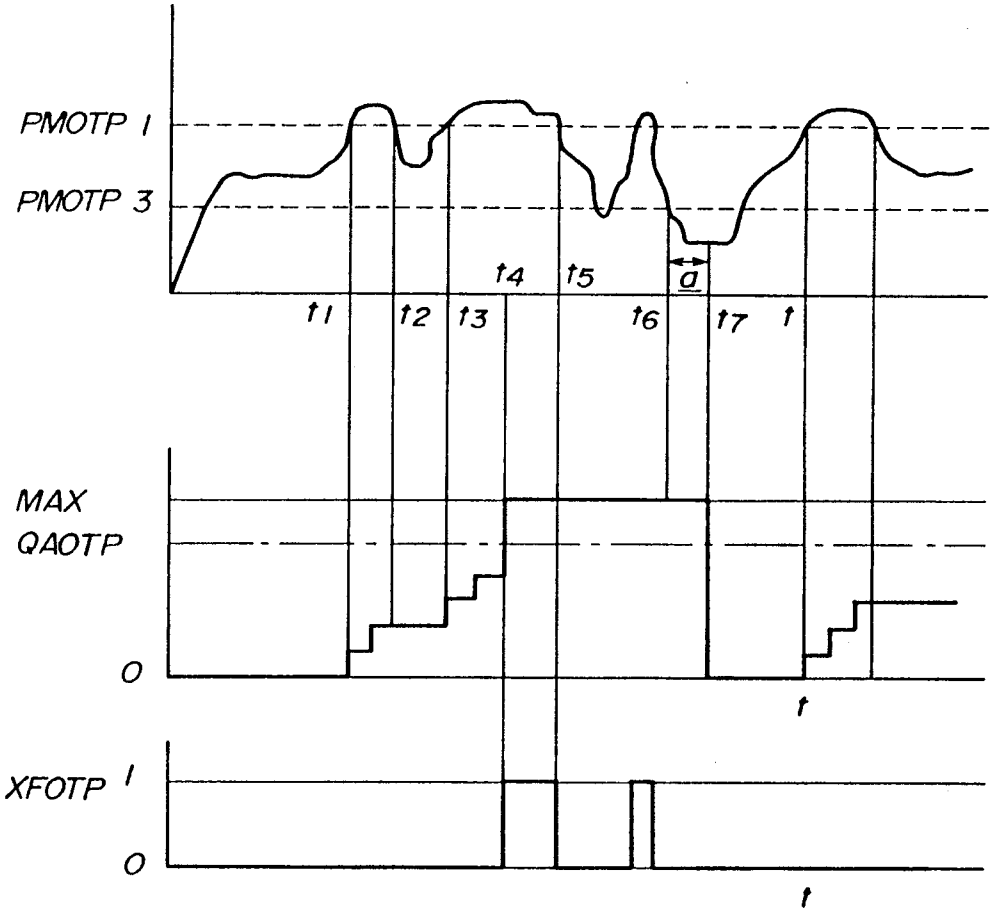
FIGS.9A through 9C are time charts for explaining changes of a delay count and an OTP process enable flag during the delay time process is carried out.

Next, a description will be given of changes in the detected intake vacuum pressure PM, changes in the count COTPDY and changes in the OTP process enable flag XFOTP during the delay time process of FIG.4. FIG.9A shows changes in the intake vacuum pressure PM with respect to the elapsed time t. FIG.9B shows changes in the count COPTDY with respect to the elapsed time t. When an intake vacuum pressure PM is higher than the reference value PMOTP1 (from a time t1 to a time t2 in FIG.9A), the delay count COTPDY is incremented one by one as shown in FIG.9B. When the detected PM changes to a level lower than the reference value PMOTP1 and higher than the reference value PMOTP3 (from time "t2" to time "t3" in FIG.9A), the value of the count COTPDY is maintained, remaining unchanged from the previous count value, as shown in FIG.9B. According to the present invention, it is judged that the exhaust parts are still not cool enough if the PM is lower than the PMOTP1 and higher than the PMOTP3. As the PM changes and becomes higher than the PMOTP1 (from time "t3" to time "t4" in FIG.9A), the delay time counting is again performed so that the value of the count COTPDY is further increased. If the value of the count COTPDY is greater than a prescribed value of the QAOTP (at time "t4" in the time chart), the maximum value is set to the count COTPDY. The value of the count COTPDY is continuously equal to the maximum value for a time period between time "t4" and time "t7" in the time chart.

FIG.9C shows changes in the flag XFOTP with respect to the elapsed time. When the maximum value is set to the COTPDY, the flag XFOTP is set to 1 and the OTP process is performed so that the fuel injection time is increased. The PM changes and becomes lower than the PMOTP3. When the condition in which the PM is below the PMOTP3 continues over a predetermined time period of "a" sec (from time"t6" to time "t7" in the time chart), the count COTPDY is reset to the value zero. According to the present invention, it is judged that the exhaust parts are cool enough at this time.

The delay count value COTPDY is incremented (step 205) when the engine operating conditions continue to stay in the OTP region and the exhaust part temperatures are increasing. When the engine is operating in low-load operating conditions over the predetermined time period "a" and the exhaust parts are cool enough, the delay count COTPDY is set to the value zero (step 109). In short, the value of the delay count COPTDY represents the level of the exhaust part temperature, or it indicates the heat condition of the exhaust parts prior to the detection of the high load conditions of the engine. The greater the value of the delay count COPTDY, the shorter the delay time.

Figure 7:
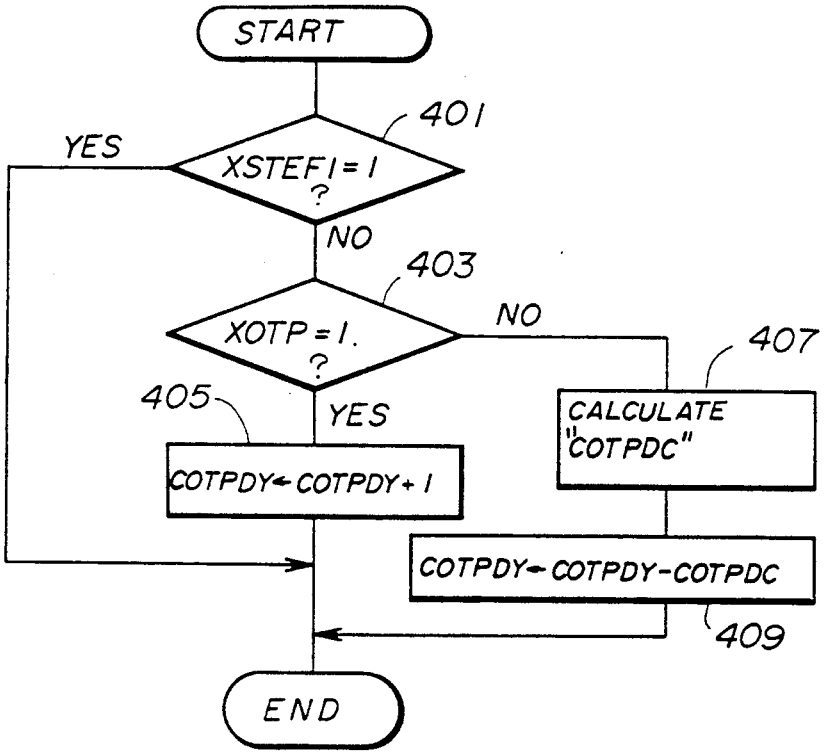
FIG.7 is a flow chart for explaining another delay counting process in which a delay count is determined by decrementing the delay count.

FIG.7 shows another delay counting process of the present invention in a second embodiment. Similar to the process of FIG.5, this delay counting process is performed as a subroutine of the main routine of FIG.4. The delay counting process of FIG.7 differs from that of FIG.4 in that additional steps 407 and 409 are performed so that when it is detected in step 403 that the flag XOTP is not equal to 1, a down counting of the COTPDY is performed. More specifically, in step 407, a decrement COTPDC is read out from map data stored in the ROM 31 based on the detected flow rate of intake air. The following TABLE 3 shows decrement values COTPDC on of which is read out in step 407. The decrement values COTPDC are stored in the ROM 31 and they are preset in accordance with the flow rate values QA of intake air.

TABLE 3

| QA(1/s) | less than 10 | less than 15 | less than 20 |
|---|---|---|---|
| COTPDC(s) | 1.0 | 0.5 | 0.2 |

In step 409, the decrement COTPDC is subtracted from the delay count COTPDY (COTPDY←COTPDY−COTPDC). In the first embodiment, it is judged that the exhaust parts are cool enough when the time period during which the operating conditions continues to stay in the region "C" (the low-load heat condition) is greater than the predetermined time period value "a". In the second embodiment, the decrement values COTPDC are preset in accordance with the intake flow rate values QA. The values COTPDC increase when the flow rate QA decrease, as shown in TABLE 3 above. Thus, it is possible to accurately measure a heat condition of the exhaust parts by suitably incrementing and decrementing the delay count value COTPDY.

In the above described embodiments, the function of the detection part 40 is achieved by performing step 111 of FIG.4, the function of the fuel injection control part 60 is achieved by performing the process of FIG.6, the functions of the delaying part 50 and the delay time control part 80 are achieved by performing steps 117 to 125 of FIG.4, and the function of the heat condition measuring part 70 is achieved by performing steps 101 to 109 and step 205 of FIG.5.

Further, the present invention is not limited to the above described embodiments, and variations and modifications may be made without departing from the scope of the present invention.

I claim:

1. A fuel injection control apparatus for an internal combustion engine, said apparatus comprising:

detection means for detecting whether or not the internal combustion engine is operating in prescribed high load conditions;

fuel injection control means for increasing a fuel injection time during which an amount of fuel proportional to the fuel injection time is supplied to the engine;

delaying means for delaying increase of the fuel injection time by said fuel injection control means until a delay time has elapsed since high load conditions were detected by said detection means;

heat condition measuring means for measuring a heat condition of exhaust parts of said engine prior to said detection of said high load conditions; and delay time control means for varying said delay time of said delaying means in response to the measured heat condition of the exhaust parts supplied by said heat condition measuring means during said high load conditions of said engine.

2. An apparatus according to claim 1, wherein said heat condition measuring means increments a first delay count value when said high load conditions of said engine are detected by said detection means, thereby measuring said heat condition of said exhaust parts.

3. An apparatus according to claim 2, wherein said delay time control means enables said fuel injection control means to immediately increase the fuel injection time when said first delay count value is greater than a prescribed time period value, said time period value being preset in accordance with an intake air flow rate, and said delay time control means preventing said fuel injection control means from increasing the fuel injection time when the said first delay count value is not greater than a prescribed time period value, thereby varying said delay time of said delaying means.

4. An apparatus according to claim 1, wherein said heat condition measuring means measures said heat condition of said exhaust parts by incrementing a first delay count value when an intake vacuum pressure higher than a prescribed high-load reference value is detected, said high-load reference value being preset in accordance with a detected engine speed value detected by a sensor provided in the engine.

5. An apparatus according to claim 4, wherein said delay time control means enables said fuel injection control means to immediately increase the fuel injection time when said first delay count value is greater than a prescribed time period value, said time period value being preset in accordance with an intake air flow rate, and said delay time control means preventing said fuel injection control means from increasing the fuel injection time when said first delay count value is not greater than a prescribed time period value, thereby varying said delay time of said delaying means.

6. An apparatus according to claim 1, further comprising memory means for storing high-load reference values of intake vacuum pressure, said high-load reference values being preset in accordance with engine speed values, and said detection means detecting said high load conditions of said engine by determining whether or not a detected intake vacuum pressure is higher than a prescribed high-load reference value read out from said memory means in response to a detected engine speed value.

7. An apparatus according to claim 1, wherein said heat condition measuring means increments a second delay count value when an intake vacuum pressure lower than a prescribed low-load reference value is detected by a vacuum sensor mounted in an intake pipe of the engine.

8. An apparatus according to claim 7, wherein said heat condition measuring means resets the first delay count value to zero when it is detected that said second delay count value is greater than a prescribed time period count value.

9. An apparatus according to claim 1, further comprising memory means for storing low-load reference values of intake vacuum pressure, said low-load reference values being preset in accordance with engine speed values, and said heat condition measuring means incrementing a second delay count value when it is detected that a detected intake vacuum pressure is lower than a prescribed low-load reference value read out from said memory means in response to a detected engine speed value.

10. An apparatus according to claim 1, wherein said detection means detects whether or not a detected intake vacuum pressure value detected by a vacuum sensor mounted in an intake pipe of the engine, is higher than a prescribed high-load reference value read out from stored map data in respect to a detected engine speed value detected by a sensor provided in the engine, thereby detecting whether or not said engine is operating in said high load conditions.

11. An apparatus according to claim 1, wherein said heat condition measuring means decrements a first delay count value when an intake vacuum pressure lower than a prescribed high-load reference value is detected, said high-load reference value being present in accordance with a detected engine speed value detected by a sensor provided in the engine, and values of said decrement which is subtracted from the first delay count value, varying in accordance with an intake air flow rate.

12. A fuel injection control apparatus for an internal combustion engine, the apparatus comprising:

detection means for detecting whether or not the internal combustion engine is operating in prescribed high load conditions;

fuel injection control means for increasing a fuel injection time during which an amount of fuel proportional to the fuel injection time is supplied to the engine;

delaying means for delaying increase of the fuel injection time by the fuel injection control means until a delay time has elapsed since high load conditions were detected by the detection means;

heat condition measuring means for measuring a heat condition of exhaust parts of the engine prior to the detection of the high load conditions; and delay time control means for gradually varying the delay time of the delaying means between a predetermined first value and a predetermined second value based on the measured heat condition of the exhaust parts supplied by the heat condition measuring means during the high load conditions of the engine.

* * * * *

UNITED STATES PATENT AND TRADEMARK OFFICE

CERTIFICATE OF CORRECTION

PATENT NO. : 5,239,965

DATED : 31 Aug. 1993

INVENTOR(S) : Masahito NINOMIYA

It is certified that error appears in the above-indentified patent and that said Letters Patent is hereby corrected as shown below:

| Column | Line | |
|---|---|---|
| 1 | 17 | Change "exhasut" to --exhaust--. |
| 3 | 38 | After "during" insert --which--. |
| 3 | 56 | Change "unitl" to --until--. |
| 8 | 60 | Change "COPTDY" to --COTPDY--. |
| 9 | 35 | Change "COPTDY" to --COTPDY--. |
| 9 | 39 | Change "COPTDY" to --COTPDY--. |
| 9 | 51 | Change "on" to --one--. |
| 9 | 64 | Change "continues" to --continue--. |
| 12 | 15 | Change "is" to --are--. |

Signed and Sealed this

Third Day of October, 1995

Bruce Lehman

*Attest:*

BRUCE LEHMAN

*Attesting Officer*

*Commissioner of Patents and Trademarks*